US012560107B2

(12) United States Patent
Ronchieri et al.

(10) Patent No.: US 12,560,107 B2
(45) Date of Patent: Feb. 24, 2026

(54) GLAND CONDENSER SKID SYSTEMS BY SHELL AND PLATES TECHNOLOGY

(71) Applicant: NUOVO PIGNONE TECNOLOGIE—SRL, Florence (IT)

(72) Inventors: Andrea Ronchieri, Massa-Carrara (IT); Alessandro Szorenyi, Massa-Carrara (IT)

(73) Assignee: Nuovo Pignone Tecnologie—SRL, Florence (IT)

( * ) Notice: Subject to any disclaimer, the term of this patent is extended or adjusted under 35 U.S.C. 154(b) by 179 days.

(21) Appl. No.: 18/263,467

(22) PCT Filed: Jan. 26, 2022

(86) PCT No.: PCT/EP2022/025025

§ 371 (c)(1),
(2) Date: Jul. 28, 2023

(87) PCT Pub. No.: WO2022/167147

PCT Pub. Date: Aug. 11, 2022

(65) Prior Publication Data

US 2024/0077001 A1 Mar. 7, 2024

(30) Foreign Application Priority Data

Feb. 3, 2021 (IT) ..... 102021000002348

(51) Int. Cl.
*F01K 9/00* (2006.01)

(52) U.S. Cl.
CPC ..... *F01K 9/003* (2013.01)

(58) Field of Classification Search
CPC . F01K 9/003; F01K 9/00; F01D 11/04; F01D 25/32; F01D 25/26; F28B 9/06; F28B 1/02
USPC ..... 165/166
See application file for complete search history.

(56) References Cited

U.S. PATENT DOCUMENTS 5,749,227 A * 5/1998 Smith ..... F01D 11/00 60/657
5,913,812 A * 6/1999 Smith ..... F01D 11/06 60/657
5,941,506 A * 8/1999 Smith ..... F01D 11/02 137/312
6,698,182 B2 * 3/2004 Sonoda ..... F01K 23/10 60/39.182
6,918,252 B2 * 7/2005 Zimron ..... F01K 23/04 60/656
7,284,376 B2 * 10/2007 Zimron ..... F01D 11/04 60/671
8,356,974 B2 * 1/2013 Inomata ..... F01D 19/00 415/118

(Continued)

FOREIGN PATENT DOCUMENTS

CN 101175900 A 5/2008
CN 102425958 A 4/2012

(Continued)

*Primary Examiner* — Jon T. Schermerhorn, Jr.
(74) *Attorney, Agent, or Firm* — Paul Frank + Collins P.C.

(57) ABSTRACT

The disclosure concerns a gland condenser skid system for thermodynamic machine, namely a steam turbine, the gland condenser skid system comprising a shell and plates heat exchanger as gland condenser (10), said shell and plates heat exchanger being formed of gasket-free welded tube sheets.

11 Claims, 3 Drawing Sheets

(56) References Cited

U.S. PATENT DOCUMENTS

| | | | | |
|---|---|---|---|---|
| 8,545,166 | B2 * | 10/2013 | Maruthamuthu | F01D 11/04 415/168.2 |
| 9,540,942 | B2 * | 1/2017 | Zheng | F01D 11/04 |
| 9,702,541 | B2 * | 7/2017 | Shinozaki | F03G 6/071 |
| 10,655,543 | B2 * | 5/2020 | Inoue | F02C 7/185 |
| 10,760,453 | B2 * | 9/2020 | Hirayama | F01K 23/10 |
| 11,066,715 | B2 * | 7/2021 | Shimizu | F01D 9/02 |
| 11,333,043 | B2 * | 5/2022 | Nishikawa | F16J 15/4472 |
| 11,536,160 | B2 * | 12/2022 | Nishikawa | F01D 25/26 |
| 2012/0163961 | A1 * | 6/2012 | Chevrette | F01D 11/02 415/182.1 |
| 2013/0270775 | A1 * | 10/2013 | Coffey | F02C 7/28 277/409 |

FOREIGN PATENT DOCUMENTS

| | | | |
|---|---|---|---|
| CN | 110002848 | A | 7/2019 |
| DE | 1109722 | B | 6/1961 |
| EP | 0463532 | A1 | 1/1992 |
| JP | H03233114 | A | 10/1991 |
| JP | 04080695 | A | 3/1992 |
| JP | 2012057900 | A | 3/2012 |
| JP | 2017528674 | A | 9/2017 |
| JP | 2018053738 | A | 4/2018 |
| WO | 2013/035638 | A1 | 3/2013 |

* cited by examiner

GLAND CONDENSER SKID SYSTEMS BY SHELL AND PLATES TECHNOLOGY

TECHNICAL FIELD

The present disclosure concerns a gland condenser skid system including a gland condenser based on the so called shell and plates technology. Embodiments disclosed here in specifically concern improved thermodynamic machines such as steam turbines and/or engine generators or mechanical drive stations, wherein a shell and plate heat exchanger is configured to act as gland condenser.

BACKGROUND ART

A gland condenser skid system is used to condense the steam coming from a steam turbine sealing system, in particular the steam that leaks past the first section of seals on the shaft of a steam turbine. Specifically, if the turbine exhausts into a vacuum system, it is necessary to inject sealing steam into the seals, in order to keep the low pressure end of the turbine from drawing in the atmosphere. This sealing steam from the low pressure end and the normal leakage from the high pressure end would tend to leak out and blow toward the bearing housing. In order to reduce the chance of this leakage causing an accumulation of water in the lube oil system, a gland condenser skid system is used to draw a very slight vacuum (typically 1 or 2 in-Hg) at the outer section of the shaft seals. Typically, gland condenser shell side pressure is 0.96 bara.

A gland condenser skid system includes a small heat exchanger to condense the steam and an evacuation device to extract not condensable fractions of the steam stream. Additionally, the gland condenser skid system also includes a silencer, piping, filters, valves, instrumentation and structural support.

The heat exchanger used to condense the steam coming from the steam turbine sealing system, also called gland condenser, is normally a water cooled shell and tubes heat exchanger, wherein cooling water runs through the tubes, and steam flows over the tubes (through the shell). At the bottom of the shell, where the condensate collects, an outlet is installed.

The use of shell and tubes heat exchangers as gland condenser is also required by API standard 612, the reference normative relevant to the steam turbine and its auxiliaries into Oil and Gas (Petroleum, Petrochemical and Natural Gas) market section. Its validity and application is world-wide recognized and its applicability in Oil & Gas technology can be used as direct insurance criteria for end users. According to API 612 normative, the condenser standard solution shall have a steel shell, brass or cupronickel tubes with nominal wall thickness of not less than 1.25 mm (0.050 in.) and a diameter of at least 15.88 mm (0.625 in.), and fixed tube sheets with water on the tube side. Alternative material choices are allowed depending on type of applied cooling water.

However, despite the high reliability of gland condensers configured as shell and tubes heat exchangers, this solution also has many drawbacks, namely:

a) high foot-printing, large volume, weight and cost;
b) low heat exchanging capacities;
c) limitation of equipment use, due to the overdesign level;
d) in case of tube bundle damage, it is unfeasible to plug tubes due to the condenser layout (TEMA BEM solution) that considers tube sheets welded to the channel and a not adequate channel dimension to have a proper access;
e) increased complexity of the components due to the presence of a tube bundle; and consequently
f) high installation and maintenance costs.

Shell and plates heat exchangers are not used as gland condensers, because this solution does not guarantee against any possible contamination of cooling fluid by sealing steam turbine oil. In fact, shell and plates heat exchangers do not provide for welded tube sheets system, rather, packages are joined by plates gasketed solutions, which are prone to possible leakage. The main limits of shell and plates heat exchangers are connected to high temperature and pressure cases.

SUMMARY

According to the present invention, it is proposed that shell and plates heat exchangers are used as gland condensers in Oil & Gas field. To this aim, shell and plates heat exchanger are provided with welded plates package to avoid any possible leakage and contamination.

Thus, in one aspect, the subject matter disclosed herein is directed to a shell and plates heat exchanger as gland condenser, said shell and plates heat exchanger comprising a tube sheet package with gasket exclusion (FIG. 2-3).

Additionally, in another aspect, the subject matter disclosed herein is directed to a new technology solution with higher thermal efficiency with evident benefit on dimensions, weight and cost, maintaining similar safety condition.

BRIEF DESCRIPTION OF THE DRAWINGS

A more complete appreciation of the disclosed embodiments of the invention and many of the attended advantages thereof will be readily obtained as the same becomes better understood by reference to the following detailed description when considered in connection with the accompanying drawings, wherein.

DETAILED DESCRIPTION OF EMBODIMENTS

According to one aspect, the present subject matter is directed to a gland condenser skid system comprising a shell and plates heat exchanger as gland condenser, said shell and plates heat exchanger being formed of fully welded plates.

According to another aspect, the present subject matter is directed to a gland condenser skid system comprising a gasket-free shell and plates heat exchanger as gland condenser.

Figure 1:
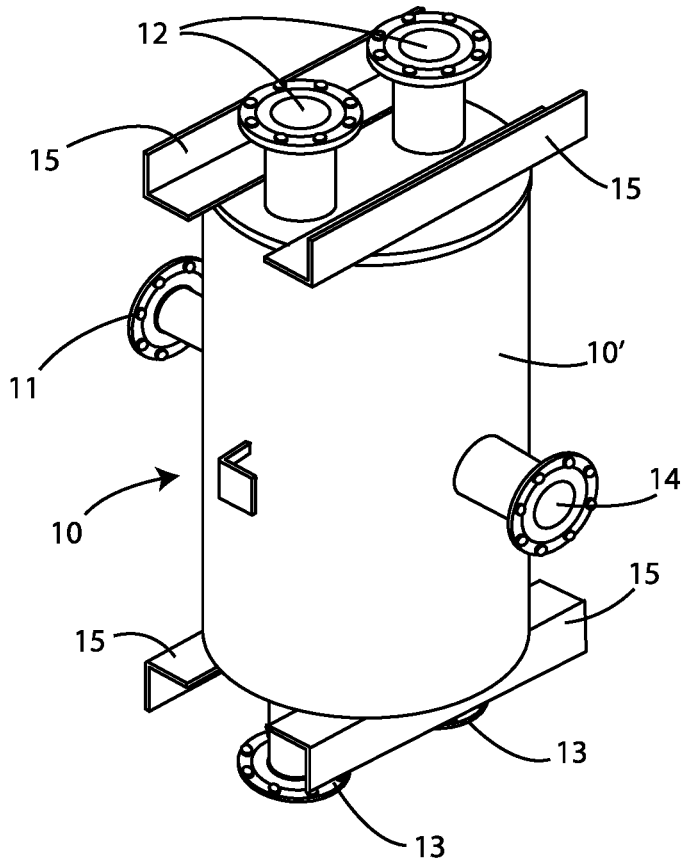
FIG. 1 illustrates a perspective view of a gland condenser composed of a shell and plates heat exchanger.

Referring now to the drawing, FIG. 1 shows a perspective view of a gland condenser composed of a shell and plates heat exchanger, indicated as a whole by the reference number 10 and comprising a shell 10', the gland condenser 10 being provided with a first inlet 11 for a flow of air and steam from a steam turbine sealing system, to be cooled, and a second inlet 12 for a flow of a cooling fluid, usually water, to exchange heat with the flow of steam and air to be cooled. The gland condenser 10 is also provided with a first outlet 13 for the flow of cooling fluid and a second outlet 14 for the flow of air and at least partially condensed steam. The flow of air and at least partially condensed steam is then conveyed to an external hot well for final separation. FIG. 1 also shows part of the structure 15 supporting the gland condenser 10.

Figure 2:
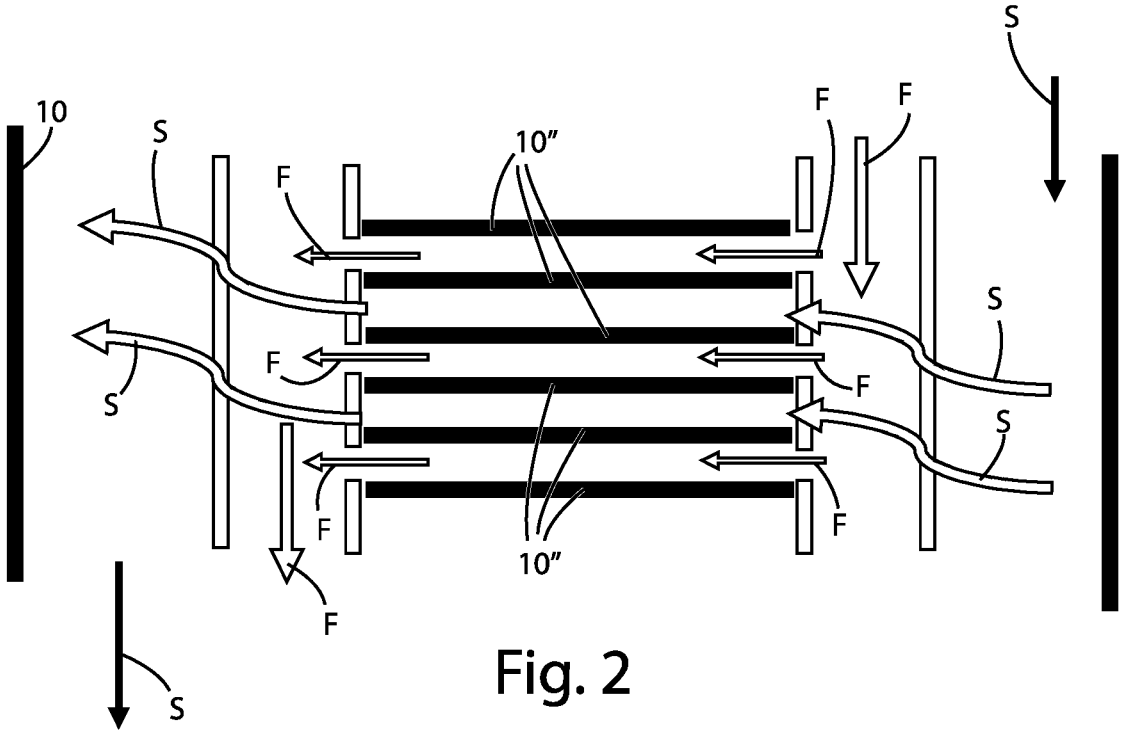
FIG. 2 illustrates a schematic view of internal flow distribution of a gland condenser composed of a shell and plates heat exchanger.

FIG. 2A illustrates a schematic view of the internal flow distribution of the gland condenser 10, composed of a shell and plates heat exchanger, comprising a plurality of plates 10", stacked on each other and still separated from each other to form a plate pack provided with a plurality free spaces, each space being comprised between two adjacent plates 10". The space comprised between two adjacent plates 10" alternately define a first flow path connecting the inlet 11 and the outlet 14 of the flow S of air and steam to be cooled and a second flow path connecting the inlet 12 and the outlet 13 of the flow F of cooling fluid. The plates 10" are welded to keep the first flow path and the second flow path separate. Heat is exchanged between the flow S of air and steam to be cooled and the flow F of cooling fluid through the plates 10". The fully welded plate pack is assembled into the shell 10'.

Figure 3A:
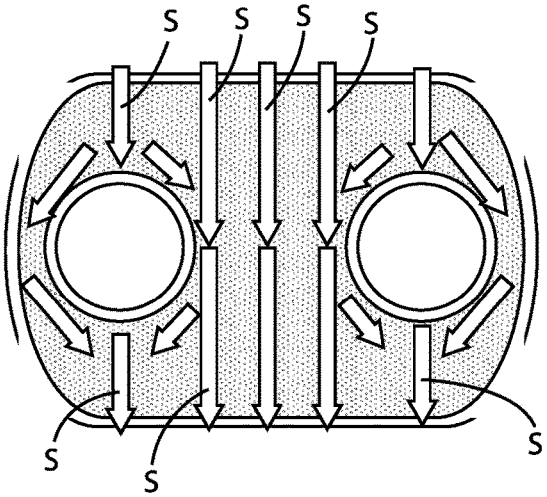
FIG. 3A illustrates a schematic view of the hot fluid internal flow distribution of a gland condenser composed of a shell and plates heat exchanger.
Figure 3B:
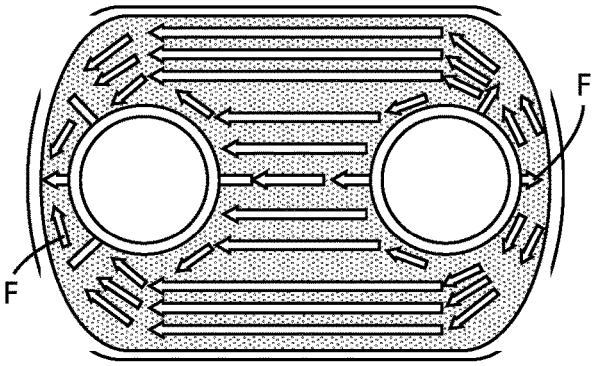
FIG. 3B illustrates a schematic view of the cold fluid internal flow distribution of a gland condenser composed of a shell and plates heat exchanger.

FIG. 3A shows the flow S of air and steam to be cooled, running on one side of a plate 10", while FIG. 3B shows the flow F of cooling fluid, running on the other side of the same plate 10".

Figure 4:
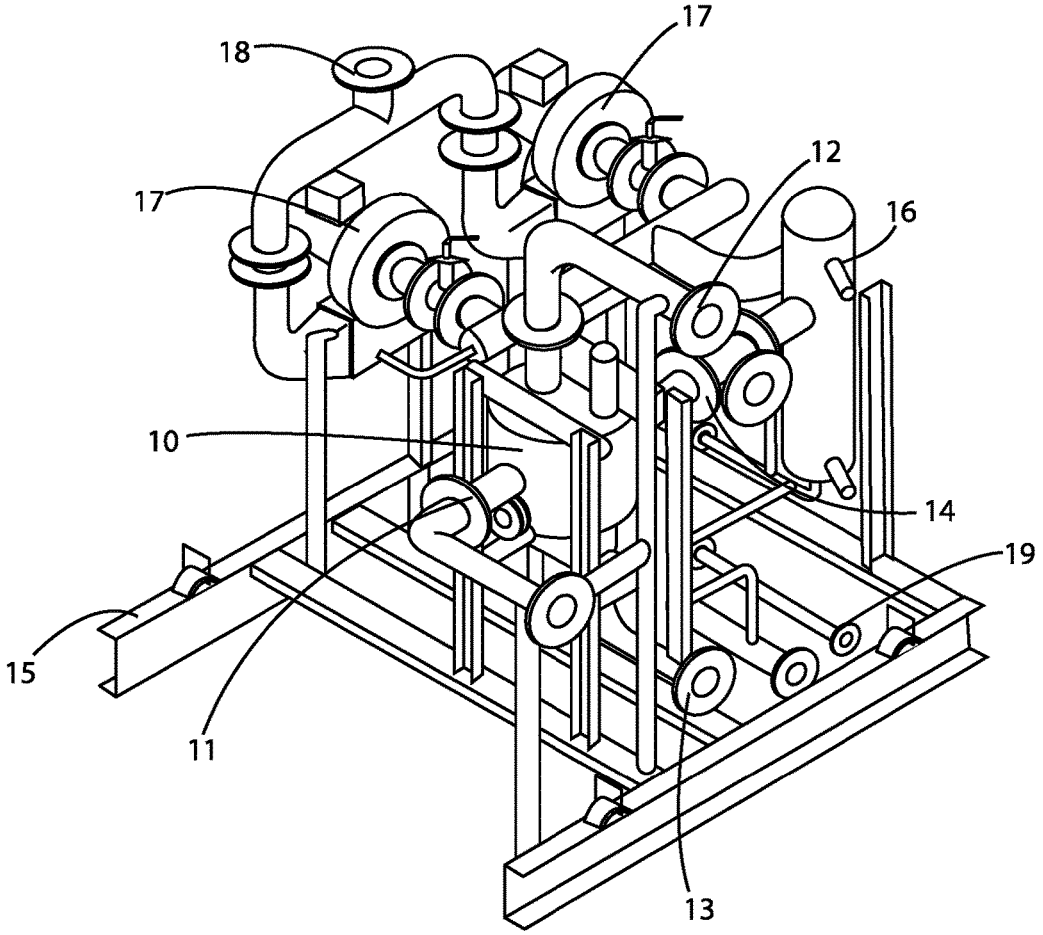
FIG. 4 illustrates a perspective view of a gland condenser system comprising a shell and plates heat exchanger as gland condenser.

FIG. 4 illustrates a perspective view of a gland condenser system comprising a shell and plates heat exchanger as gland condenser 10 according to the present disclosure, the gland condenser system also comprising a tank 16 for additional separation of condensate from the flow S of air and steam, two motorized evacuation fans 17, or alternatively a steam ejector system, for evacuation of residual air and steam through an outlet 18 and an outlet 19 for evacuation of condensate.

Figure 5:
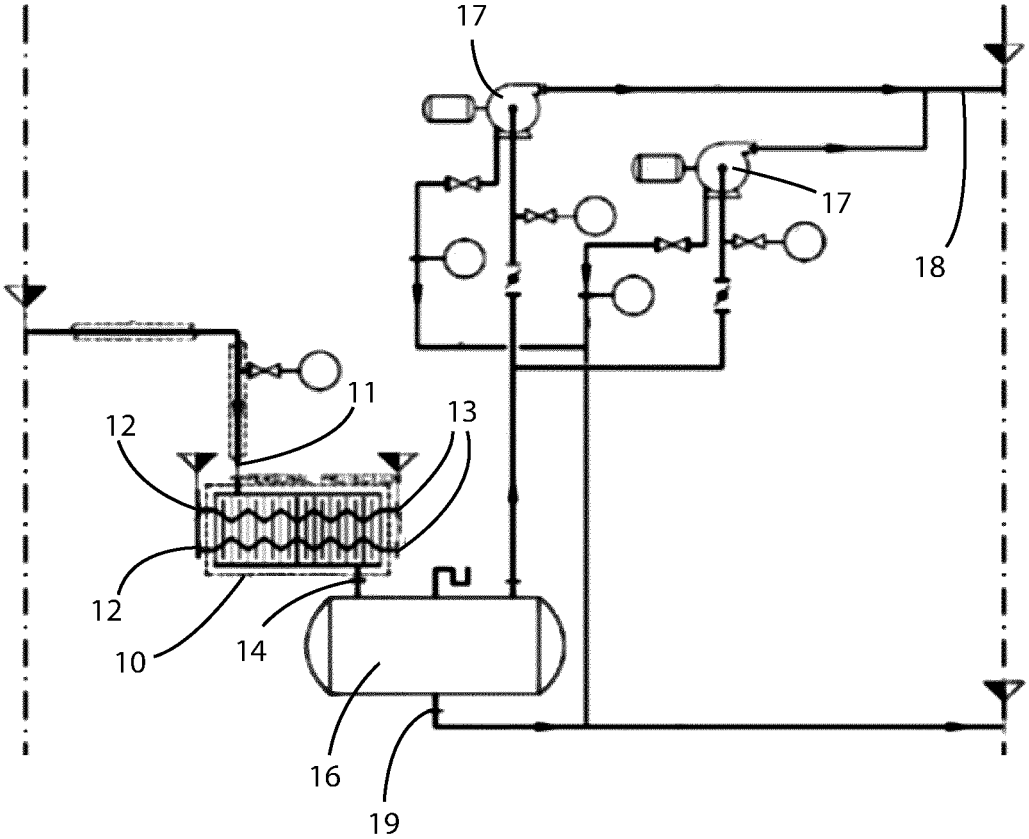
FIG. 5 illustrates a schematic view of a piping and instrumentation diagram (P&ID) of a gland condenser system comprising a shell and plates heat exchanger as gland condenser.

FIG. 5 illustrates a schematic view of a piping and instrumentation diagram (P&ID) of a gland condenser system comprising a shell and plates heat exchanger as gland condenser according to the present disclosure.

The gland condenser skid system including a gland condenser based on shell and plates technology involves many advantages over a gland condenser based on shell and tubes technology, including:

- more compact and flexible lay-out, the shell and plates heat exchanger allowing a higher efficiency than traditional shell and tubes layout; additionally, depending on specific needs, a proper design can be developed by simple parameters optimization as vessel diameter, length and flow direction;
- higher heat transfer rate & efficiency (reduced heat exchanging surface), shell and plates heat exchangers ensuring heat exchanging coefficient up to 8 times higher than equivalent shell and tubes layouts;
- lower installation costs, with strong reduction in foot printing, volume and weight;
- lower cooling water flow request, as a consequence of a strongly higher heat exchanging coefficient; important saving of cooling water flow is achieved with similar duty;
- limited and standardized heat exchange solution, since a higher performance larger standard size application is obtained;
- performance reliability & robust design;
- low hold-up volume, reliable and cost-effective production in a variety of petrochemical applications; in particular, over shell and tubes technology, cost benefits are comprised in the range of 15-35% depending on materials and size classes;
- solid Resistance to fatigue, due to plates layout (i.e. corrugated shape) and geometrical control able to exclude fatigue issue;
- ability to work with liquids, gases and two-phase mixtures, including a wide range of aggressive media, implying no limitation with respect to fluid typology and corrosion/erosion effects;
- ability to handle pressures up to 100 bar g (1450 psi g) as per PED and ASME, along with temperatures as high as 450° C., due to fully welded solution of tube sheet package with gasket exclusion;
- fully welded solution (corrugated tube sheet pack by laser welding) and gasket-free, to solve any leakage issue;
- materials applicability from carbon steel, stainless steel to titanium: no limitation for material selection able to cover any cooling water type.

While aspects of the invention have been described in terms of various specific embodiments, it will be apparent to those of ordinary skill in the art that many modifications, changes, and omissions are possible without departing form the spirt and scope of the claims.

The invention claimed is:

1. A gland condenser skid system, comprising:

a shell and plates heat exchanger, the shell and plates heat exchanger comprising a shell and plates disposed therein, the plates arranged in a stack forming a first flow path and a second flow path, wherein the plates are welded to separate flow in the first flow path from flow in the second flow path without gaskets;

an evacuation system; and a tank connected downstream of the shell and plates heat exchanger, the tank comprising a top and a bottom, wherein the top of the tank is connected to the evacuation system.

2. The system according to claim 1, further comprising:

a fan, wherein the top of the tank is connected to the evacuation system by the fan.

3. The system according to claim 1, further comprising:

a steam ejector, wherein the top of the tank is connected to the evacuation system by the steam ejector.

4. The system according to claim 1, further comprising:

a condensate outlet, wherein the bottom of the tank is connected to the condensate outlet.

5. The system according to claim 1, wherein the shell comprises a top and a bottom, both having an opening.

6. The system according to claim 1, wherein the shell comprises a cylinder with elongate sides and opposing openings disposed in the sides.

7. The system according to claim 1, wherein the shell comprises a cylinder with elongate sides, a top, a bottom, and opposing openings disposed in the top and the bottom.

8. The system according to claim 1, wherein the shell comprises a cylinder with elongate sides, a top, a bottom, and opposing openings disposed in the top and the bottom, and the sides.

9. A steam turbine comprising the gland condenser skid system of claim 1.

10. A engine generator comprising the gland condenser skid system of claim 1.

11. A mechanical drive station comprising the gland condenser skid system of claim 1.

* * * * *